United States Patent [19]

Pratt

[11] 4,036,079

[45] July 19, 1977

[54] BRAKE LOCK KNOB ASSEMBLY

[75] Inventor: Albert R. Pratt, Weston, Mass.

[73] Assignee: Raytheon Company, Lexington, Mass.

[21] Appl. No.: 682,436

[22] Filed: May 3, 1976

[51] Int. Cl.[2] ..... G05G 5/06; G05G 1/10

[52] U.S. Cl. ..... 74/531; 74/554

[58] Field of Search ..... 74/531, 554; 192/18 R; 338/200; 200/156

[56] References Cited

U.S. PATENT DOCUMENTS

| | | | |
|---|---|---|---|
| 2,509,058 | 5/1950 | Haury | 74/531 |
| 3,057,223 | 10/1962 | Korsgren | 74/531 |
| 3,986,409 | 10/1976 | Tripp et al. | 74/554 |

*Primary Examiner*—Carlton R. Croyle
*Assistant Examiner*—G. P. LaPointe
*Attorney, Agent, or Firm*—John T. Meaney; Joseph D. Pannone; Harold A. Murphy

[57] ABSTRACT

A brake lock knob assembly comprising a bushing disposed to bindingly engage an axially inserted shaft end portion and having a first frictional brake surface disposed in releasable resilient engagement with a second frictional brake surface of an adjacent nonrotatable member, and an axially movable knob shell having an inwardly projecting portion disposed to disengage the brake surfaces and having interlocking means for rotatably engaging the bushing .

10 Claims, 3 Drawing Figures

FIG. 1
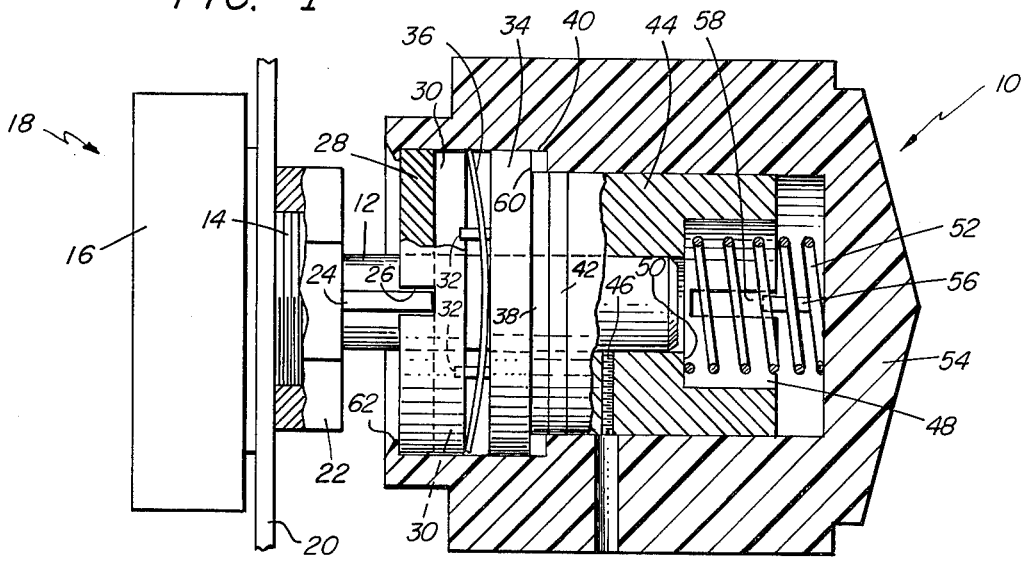
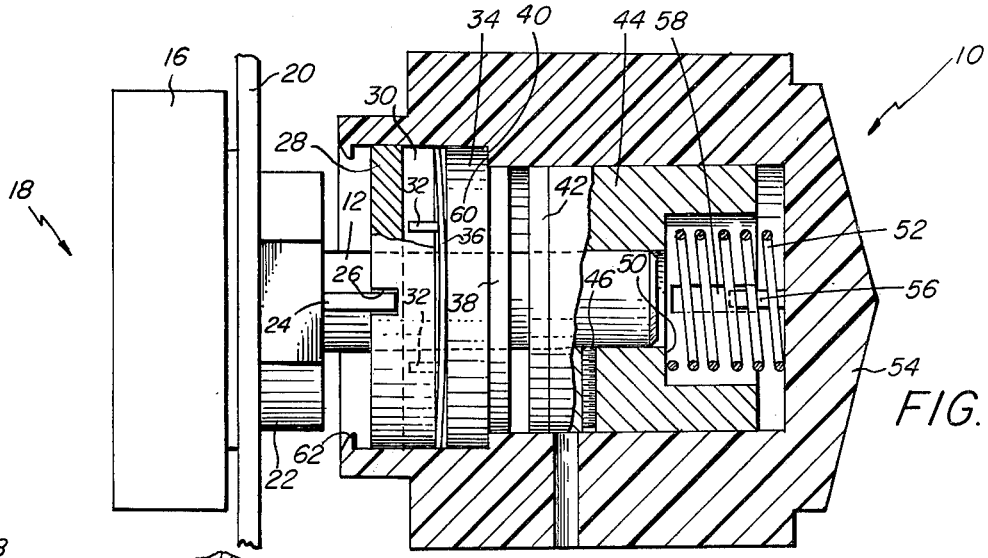
FIG. 2
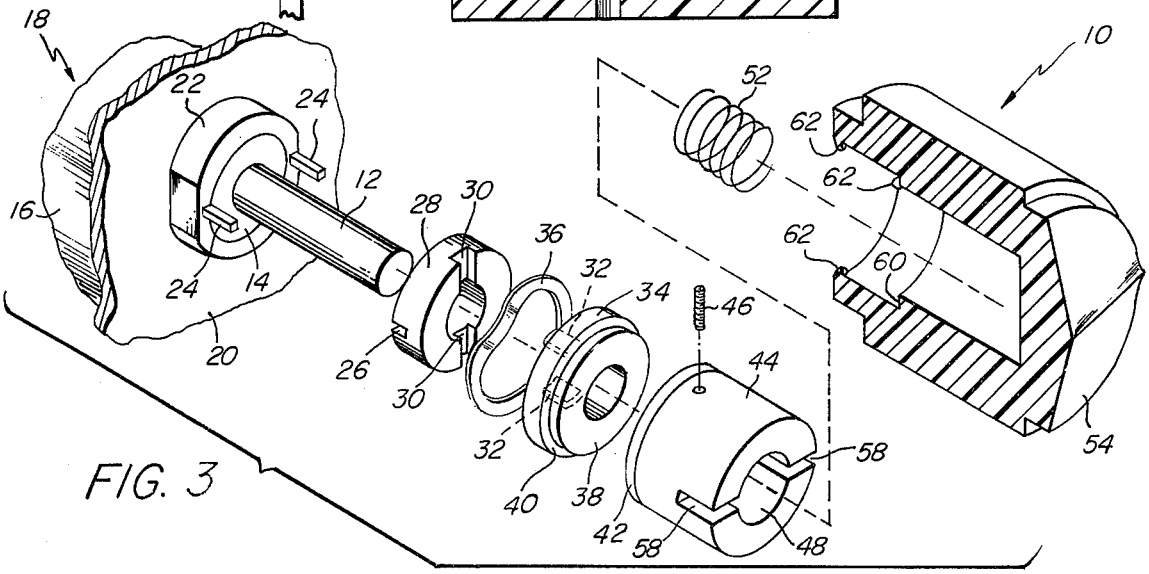
FIG. 3

BRAKE LOCK KNOB ASSEMBLY

BACKGROUND OF THE INVENTION

1. Field of the Invention

The invention relates generally to adjustment knobs and is concerned more particularly with a knob assembly having means for controllably locking a rotatable shaft in a selected angular position.

2. Discussion of the Prior Art

Control devices, such as valves, times, rheostats, potentiometers and the like, generally are provided with a protruding shaft which may be rotated to adjust the device to a desired setting. A knob may be affixed to a distal end portion of the shaft such that rotation of the knob will produce a corresponding rotation of the shaft. Also, for critically adjusted devices, for example, the knob may be provided with suitable locking means for maintaining the rotatable shaft in a selected angular position until a new adjustment is required.

Thus, U.S. Pat. No. 2,787,353 granted to L. Sparagen discloses a push-to-turn knob assembly having resilient locking means interacting with a plurality of coaxial cylinders for maintaining an axially disposed shaft in a selected angular position. However, locking means of the described type generally involve a plurality of parts having tight dimensional tolerances to avoid interference engagements which may cause malfunction of the knob assembly. Furthermore, these prior art knob assemblies generally are expensive due to the time consuming operation of assembling the plurality of interacting parts into a relatively complicated structure.

Therefore, it is advantageous and desirable to provide a knob assembly of the described type with a comparatively inexpensive and readily assembled structure.

SUMMARY OF THE INVENTION

Accordingly, this invention provides a control knob assembly comprising a cup-shaped knob shell having axially disposed therein a bushing provided with fastening means for bindingly engaging an inserted rotatable shaft. The closed end of the knob shell is provided with key means for rotatably engaging the adjacent end surface of the bushing, and is resiliently spaced therefrom. The opposing end surface of the bushing is provided with a first frictional brake surface which is lockingly engaged by a second frictional brake surace of a resiliently mounted disc encircling the shaft. An annular marginal portion of the disc extends beyond the brake surfaces and is aligned with a resiliently spaced shoulder of the knob shell.

Thus, pressing the knob shell axially causes the shoulder to engage the annular marginal portion of the disc and separate the brake surfaces. Simultaneously the key means at the closed end of the shell interlockingly engages the bushing to transmit rotary movement of the knob shell to the rotatable shaft. Releasing the knob shell disengages the interlocking key means and withdraws the annular shoulder from pressing engagement with the marginal portion of the disc. Consequently, the second friction brake surface of the disc is resiliently urged into locking engagement with the first frictional brake surface of the bushing thereby maintaining the shaft in the newly selected angular position.

BRIEF DESCRIPTION OF THE DRAWINGS

For a better understanding of this invention, reference is made in the following more detailed description to the accompanying drawings wherein:

FIG. 1 is an elevational view, partly in section, showing a preferred embodiment of the invention with the knob in a disengaged position;

FIG. 2 is an elevational view, partly in section, showing the embodiment of FIG. 1 with the knob in an engaged position; and FIG. 3 is an exploded view showing the component parts of the preferred embodiment shown in FIGS. 1 and 2.

DESCRIPTION OF THE PREFERRED EMBODIMENT

Referring to the drawing wherein like characters of reference designate like parts, there is shown in FIGS. 1-3 a control knob assembly 10 mounted on a distal end portion of a rotatable shaft 12. The shaft 12 may extend axially through a threaded collar 14 and into an attached housing 16 of a control device 18, such as a potentiometer, for example. Thus, rotational movement of shaft 12 correspondingly rotates a control element (not shown) in housing 16, such as a wiper arm of a potentiometer, for example, thereby adjusting the control device 18 to a desired setting. The device 18 may be mounted on a control panel 20 by passing the shaft 12 and collar 14 axially through a suitably configured aperture (not shown) in the panel and threading a nut 22 onto the collar 14. Accordingly, one surface of the nut 22 is brought into binding engagement with an abutting surface of panel 20 to secure the housing 16 thereto in a nonrotatable manner.

Protruding outwardly from the opposing surface of nut 22 is a diametrically spaced pair of rigid fingers 24. The fingers 24 extend into respectively aligned slots 26 (only one being shown) which are radially disposed in an adjacent surface of an axially aligned ring 28. Thus, the ring 28 is supported in a nonrotatable manner by the rigid fingers 24. Orthogonally disposed in the opposing surface of ring 28 is a pair of radially extending slots 30 into which protude end portions of respective tabs 32. The tabs 32 extend axially from an adjacent surface of an annular disc 34 and pass freely through an interposed resilient means, such as bowed spring washer 36, for example. Accordingly, the disc 34 is held in a nonrotatable manner by the ring 28. The washer 34 is made of suitable resilient material, such as beryllium copper, for example, and resiliently spaces the disc 34 from the ring 28. Alternatively, the interposed resilient means may comprise a corrugated annulus having a plurality of alternate crests and troughs, such as a washer or a tubular bellows, for example.

The opposing surface of disc 34 is provided with an annular layer of high friction material such as neoprene, for example, which constitutes a first frictional brake shoe 38. The first brake shoe 38 has a smaller diameter than the disc 34, thus providing an annular marginal shoulder 40 which encircles the brake shoe 38 and extends radially outward therefrom. The brake shoe 38 is urged resiliently, by spring washer 36, against a second brake shoe 42 having a diameter substantially equal to the diameter of the first brake shoe 38. Second brake shoe 42 comprises an annular layer of high friction material such as neoprene, for example, which is supported on an adjacent end surface of an axially aligned bushing 44. Bushing 44 has a diameter approximately equal to the diameter of second brake shoe 42. The bushing 44 is provided with fastening means comprising a radially extending screw 46 which may be journaled into binding engagement with an inserted axially disposed shaft 12. Bushing 44 extends axially beyond the distal end of shaft 12 and has an opening end portion provided with a centrally disposed cavity 48.

Cavity 48 terminates at its inner end in an annular land 50 which supports one end of a coil spring 52. The coil spring 52 extends axially out of cavity 48 and bears against a closed end of a cup-shaped knob shell 54. Coil spring 46 extends between respective radially disposed wafer keys 56 which protrude from the closed end of knob shell 54. The keys 56 extend into entrance portions of respectively aligned slots 58 which are radially disposed in the adjacent surface of the bushing 44. Thus, the coil spring 52 resiliently spaces the closed end of knob shell 52 from the adjacent end of bushing 44 and positions the keys 56 in the entrance portions of respectively aligned slots 56.

The inner surface of knob shell 54, adjacent the open end thereof, is provided with an inwardly extending, annular shoulder 60. Shoulder 60 is axially aligned with the annular shoulder 40 of disc 34 and is axially spaced therefrom by the action of coil spring 52 bearing against the closed end of knob shell 54. The knob shell 54 may be made of a flexible plastic material, such as polycarbonate, for example, and may be molded with the keys 56, the annular shoulder 60, and a plurality of lugs 62 adjacent the open end of the knob, as integral parts of the knob shell. Thus, the knob shell 54 may be sprung open by forcing the open end thereof axially over the disc 34 and the ring 30 until the lugs 62 snap over the peripheral edge of ring 30 adjacent the nut 22.

In operation, the knob shell 54 is prevented from rotating bushing 44 and attached shaft 12 by means of the associated second brake shoe 42 being lockingly engaged by the nonrotatable first brake shoe 38, as shown in FIG. 1. However, when the knob shell 54 is pressed axially with sufficient force to overcome the coil spring 52, the annular shoulder 60 of knob shell 54 is brought into contact with the annular shoulder 40 of disc 34. Continued axial pressure on the knob shell 54 causes the spring washer 36 to yield and thereby allow the first brake shoe 38 to disengage from the second brake shoe 42 as shown in FIG. 2. Simultaneously, the keys 56 of knob shell 54 fully engage the respectively aligned slots 58 of bushing 44. Consequently, rotation of the knob shell 54 produces a corresponding rotation of the bushing 44 and the attached shaft 12. When the desired setting of control device 18 is achieved, the knob shell 54 is released thereby permitting the spring washer 36 to bring the first brake shoe 38 into locking engagement with the second brake shoe 42. Also, the coil spring 52 resiliently spaces the annular shoulder 60 of knob shell 54 axially away from the annular shoulder 40 of disc 34, and resiliently repositions the keys 56 in the entrance portions of the respectively aligned slots 58. Accordingly, the engaged first and second brake shoes, 38 and 42, respectively, lock the rotatable shaft 12 in the newly selected angular position.

Thus, it may be seen that all of the objectives of this invention have been achieved by the knob assembly disclosed herein. However, it also will be apparent that various changes may be made by those skilled in the art without departing from the spirit of the invention as expressed in the appended claims. It is to be understood, therefore, that all matter shown and described herein is to be interpreted in an illustrative rather than in a limiting sense.

What is claimed is:

1. A control knob assembly for mounting on an end portion of a rotatable shaft and comprising:

a bushing disposed to encircle the end portion of the shaft and having first interlocking means for transmitting rotational movement to the shaft, the bushing also being provided with first frictional means for preventing rotational movement of the shaft;

a nonrotatable member disposed adjacent the bushing and having second frictional means disposed to releasably engage the first frictional means for locking the shaft in a preselected angular position;

a cup-shaped knob shell coaxially disposed with respect to the bushing, the shell having releasing means for disengaging the frictional means and having second interlocking means for transmitting rotational movement to the shaft; and spring means disposed between the bushing and the shell for resiliently positioning the shell in predetermined relationship with the bushing.

2. A control knob assembly as set forth in claim 1 wherein the first frictional means includes friction enhancing material disposed on annular end portion of the bushing adjacent the open end of the cup-shaped knob shell.

3. A control knob assembly as set forth in claim 2 wherein the nonrotatable member includes an annular disc aligned with the friction enhanced end portion of the bushing.

4. A control knob assembly as set forth in claim 3 wherein the second frictional means includes friction enhancing material disposed on the surface of the disc adjacent the friction enhanced end surface of the bushing.

5. A control knob assembly as set forth in claim 4 wherein the nonrotatable member includes resilient means for urging the friction enhanced surface of the disc into locking engagement with the friction enhanced surface of the bushing.

6. A control knob assembly as set forth in claim 5 wherein the releasing means includes an inwardly extending portion of the knob shell disposed in spaced alignment with a marginal portion of the disc.

7. A control knob assembly as set forth in claim 6 wherein the resilient means includes an annular resilient member disposed in pressure engagement with the annular disc.

8. A control knob assembly as set forth in claim 7 wherein the inwardly extending portion of the shell comprises an annular shoulder disposed in spaced alignment with a peripheral marginal portion of the disc.

9. A control knob assembly as set forth in claim 8 wherein the first interlocking means includes fastening means supported by the bushing for bindingly engaging the rotatable shaft, and recess means disposed in the bushing adjacent the closed end of the shell.

10. A control knob assembly as set forth in claim 9 wherein the second interlocking means includes key means disposed in the closed end of the shell for rotatably engaging the recess means in the bushing.

* * * * *